US008628175B2

(12) United States Patent
Asano

(10) Patent No.: US 8,628,175 B2
(45) Date of Patent: Jan. 14, 2014

(54) INKJET HEAD, INKJET RECORDING APPARATUS, AND METHOD OF PRODUCING INKJET HEAD

(75) Inventor: Takeshi Asano, Nagoya (JP)

(73) Assignee: Brother Kogyo Kabushiki Kaisha, Nagoya-Shi, Aichi-Ken (JP)

( * ) Notice: Subject to any disclaimer, the term of this patent is extended or adjusted under 35 U.S.C. 154(b) by 361 days.

(21) Appl. No.: 13/012,007

(22) Filed: Jan. 24, 2011

(65) Prior Publication Data

US 2011/0242224 A1 Oct. 6, 2011

(30) Foreign Application Priority Data

Mar. 30, 2010 (JP) ..... 2010-077836

(51) Int. Cl.
*B41J 2/045* (2006.01)

(52) U.S. Cl.
USPC ..... 347/71

(58) Field of Classification Search
USPC ..... 347/71
See application file for complete search history.

(56) References Cited

U.S. PATENT DOCUMENTS

| | | | |
|---|---|---|---|
| 7,076,873 | B2 | 7/2006 | Sugahara et al. |
| 7,722,159 | B2 | 5/2010 | Hyakudome et al. |
| 2003/0103116 | A1 | 6/2003 | Sugahara et al. |
| 2005/0052505 | A1 | 3/2005 | Ito |
| 2009/0002444 | A1 | 1/2009 | Ito |

FOREIGN PATENT DOCUMENTS

| | | | |
|---|---|---|---|
| EP | 1291084 | | 3/2003 |
| EP | 1486331 | | 12/2004 |
| JP | 2000211125 | A | 8/2000 |
| JP | 2002-067299 | A | 3/2002 |
| JP | 2003-165216 | A | 6/2003 |
| JP | 2006240133 | A | 9/2006 |

OTHER PUBLICATIONS

Japanese Office Action in JP 2010-077836 on Jul. 3, 2012.
Japanese Decision of Rejection; Japanese Application No. 2010-077836; issued Dec. 18, 2012.

*Primary Examiner* — Jerry Rahll
(74) *Attorney, Agent, or Firm* — McCarter & English, LLP

(57) ABSTRACT

An inkjet head includes a plurality of nozzles through which ink is dischargeable out of the inkjet head, a pressure chamber plate that is made of metal, a plurality of pressure chambers that are groove portions formed in the pressure chamber plate for applying to the ink a pressure that is necessary in order to discharge the ink from the plurality of nozzles, an actuator that faces a first face of the pressure chamber plate and that includes a plurality of pressure generating portions, and a pressure chamber support member that supports the pressure chamber plate from a second face of the pressure chamber plate, the second face being an opposite face to the first face, and that is made from a material that has a Young's modulus that is greater than a Young's modulus of a material from which the pressure chamber plate is made.

15 Claims, 9 Drawing Sheets

INKJET HEAD, INKJET RECORDING APPARATUS, AND METHOD OF PRODUCING INKJET HEAD

CROSS-REFERENCE TO RELATED APPLICATION

This application claims priority to Japanese Patent Application No. 2010-077836, filed Mar. 30, 2010, the content of which is hereby incorporated herein by reference in its entirety.

BACKGROUND

The present disclosure relates to an inkjet head, an inkjet recording apparatus, and a method of producing an inkjet head.

A known inkjet recording apparatus includes an inkjet head that is adapted to discharge ink from a plurality of nozzles. As shown in FIGS. 8 and 9, pressure chambers 143, ink supply channels 131, and ink flow channels 133 are formed in a pressure chamber plate 130 in an inkjet head 110 in the known inkjet recording apparatus. The pressure chamber plate 130 is made from an alumina ceramic or the like. The ink supply channels 131 may supply ink to the pressure chambers 143. The ink flow channels 133 may feed the ink from the pressure chambers 143 to nozzle holes 121 that are formed in a nozzle plate 120. A diaphragm 150 is provided on top of the pressure chamber plate 130. A piezoelectric element unit 160 is provided on top of the diaphragm 150. A pressure may be applied to the ink in the pressure chamber 143 by a piezoelectric element active portion 162 of the piezoelectric element unit 160. The inkjet head 110 also includes a first base member 170, which serves as a spacer, and a second base member 180. The second base member 180 is used in order to fasten the inkjet head 110 to a carriage of the inkjet recording apparatus. In the inkjet head 110, a pressure within the ink is set such that a good ink meniscus is formed at a tip portion of each of the nozzle holes 121. Deformation of the piezoelectric element active portion 162 propagates the pressure that is applied to the ink in the pressure chambers 143, such that a droplet of the ink is discharged from the tip portion of each of the nozzle holes 121.

In a piezoelectric type of inkjet head that discharges the ink by using a piezoelectric element to pressurize the ink in an ink chamber, it is necessary to generate a large pressure within the ink chamber in order to discharge a large droplet of high-viscosity ink. It is therefore necessary to cause the piezoelectric element to generate a large amount of power. Generally, the power that a piezoelectric element generates is large, but the amount of change is small. Therefore, in order to achieve a large amount of change, a layered type of piezoelectric element, like that shown FIGS. 8 and 9, is often used. This means that in a case where the ink chamber has low rigidity, the entire ink chamber may be deformed at times when all of the channels are driven at the same time, and the like. In this sort of case, the required pressure may be not achieved or the discharge of the ink may become unstable. Therefore, in the known inkjet head 110 that is compatible with a high-viscosity ink, alumina ceramic, which is a highly rigid material, may be used for the ink pressure chamber plate 130. Thus the pressure chamber 143 may be formed to have higher rigidity than that formed from an ordinary metal material such as stainless steel or the like.

SUMMARY

The ceramic injection molding (CIM) method may be used as the method of forming the precise shape of the pressure chamber plate for the known inkjet head. In the CIM method, first, pellets are created by mixing a resin binder into alumina ceramic powder. Then, injection molding is performed on the pellets, after which the molded plate is fired at a high temperature. In this case, a high part precision of micron-size precision may not be obtained, because a dimensional error is caused by shrinkage. Therefore, the dimensional error may occur during the firing, reducing the yield of the finished product and raising the cost of the part.

Various exemplary embodiments of the broad principles derived herein provide an inkjet head that can be formed with highly precise dimensions and a high yield, an inkjet recording apparatus including the inkjet head, and a method of producing the inkjet head.

Exemplary embodiments provide an inkjet head. The inkjet head includes a plurality of nozzles through which ink is dischargeable out of the inkjet head, a pressure chamber plate that is made of metal, a plurality of pressure chambers that are groove portions formed in the pressure chamber plate for applying to the ink a pressure that is necessary in order to discharge the ink from the plurality of nozzles, and an actuator that faces a first face of the pressure chamber plate and that includes a plurality of pressure generating portions. Each of the plurality of pressure generating portions is adapted to impart a pressure to a corresponding one of the plurality of pressure chambers. The inkjet head also includes a pressure chamber support member that supports the pressure chamber plate from a second face of the pressure chamber plate, the second face being an opposite face to the first face, and that is made from a material that has a Young's modulus that is greater than a Young's modulus of a material from which the pressure chamber plate is made.

Exemplary embodiments also provide an inkjet recording apparatus that includes the inkjet head. The inkjet head includes a plurality of nozzles through which ink is dischargeable out of the inkjet head, a pressure chamber plate that is made of metal, a plurality of pressure chambers that are groove portions formed in the pressure chamber plate for applying to the ink a pressure that is necessary in order to discharge the ink from the plurality of nozzles, and an actuator that faces a first face of the pressure chamber plate and that includes a plurality of pressure generating portions. Each of the plurality of pressure generating portions is adapted to impart a pressure to a corresponding one of the plurality of pressure chambers. The inkjet head also includes a pressure chamber support member that supports the pressure chamber plate from a second face of the pressure chamber plate, the second face being an opposite face to the first face, and that is made from a material that has a Young's modulus that is greater than a Young's modulus of a material from which the pressure chamber plate is made.

Exemplary embodiments further provide a method of producing an inkjet head. The inkjet head includes a plurality of nozzles through which ink is dischargeable out of the inkjet head, a plurality of pressure chambers for applying to the ink a pressure that is necessary in order to discharge the ink from the plurality of nozzles, and an actuator that includes a plurality of pressure generating portions that are each adapted to impart a pressure to a corresponding one of the plurality of pressure chambers. The method includes the steps of forming the plurality of pressure chambers as groove portions in a pressure chamber plate that is made of metal, and placing a pressure chamber support member on a face of the pressure chamber plate that is opposite to another face of the pressure chamber plate that faces the actuator. The pressure chamber support member is made from a material that has a Young's modulus that is greater than a Young's modulus of the pressure chamber plate.

BRIEF DESCRIPTION OF THE DRAWINGS

Exemplary embodiments will be described below in detail with reference to the accompanying drawings in which.

DETAILED DESCRIPTION

Hereinafter, a first embodiment of the present disclosure will be explained. In the first embodiment, an inkjet head, an inkjet recording apparatus, and a method of producing the inkjet head according to the present disclosure will be explained using, as an example, a case in which the inkjet head is mounted in a known recording apparatus 1 (refer to FIG. 1) for printing on cloth.

Figure 1:
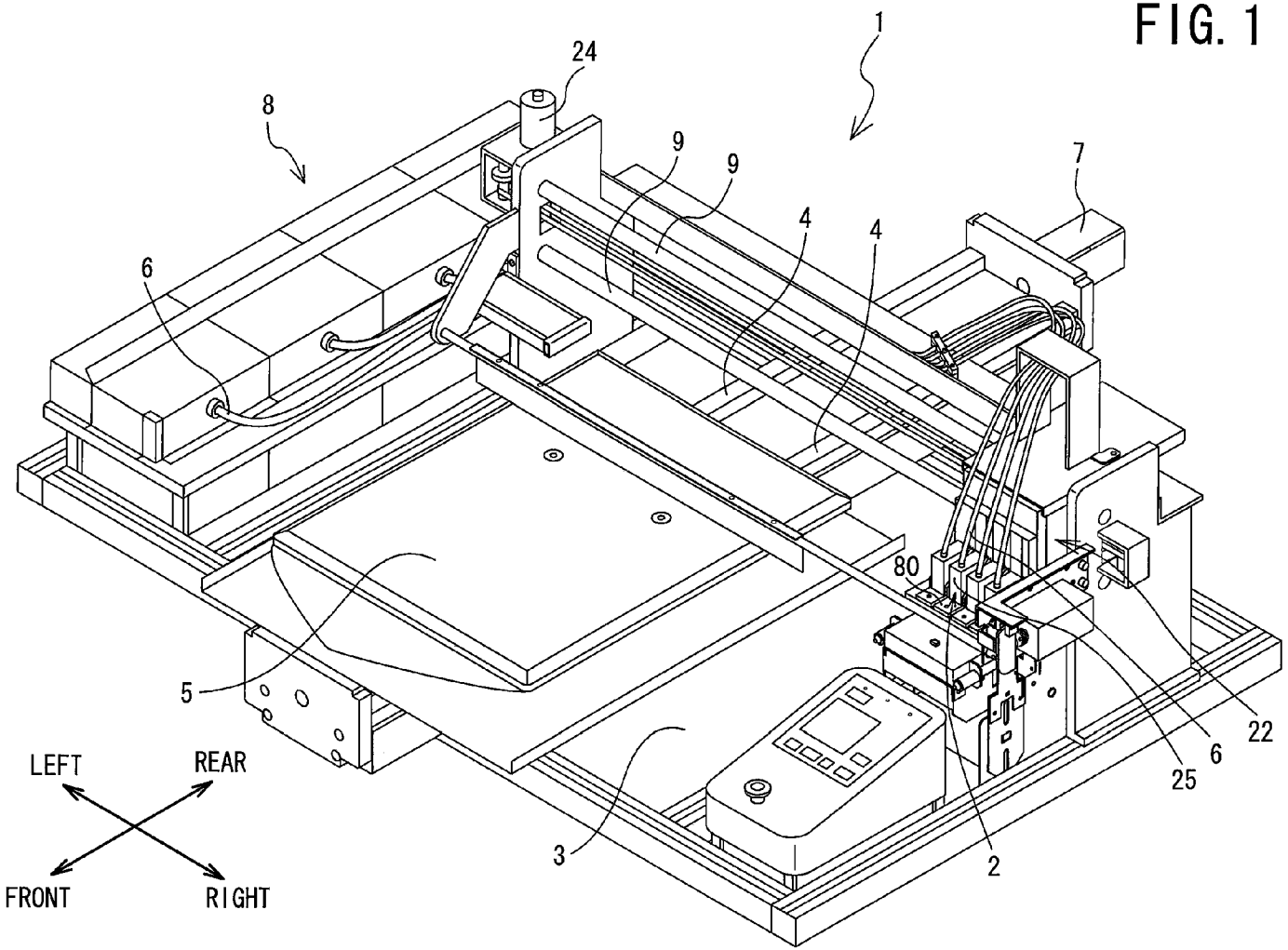
FIG. 1 is a front perspective view that shows an overall configuration of an inkjet recording apparatus 1 as seen from the right and above.

The inkjet recording apparatus 1, which performs printing on a cloth such as a T-shirt or the like, will be explained with reference to FIG. 1. In FIG. 1, the lower right side, the upper left side, the lower left side, and the upper right side of the drawing respectively correspond to the right side, the left side, the front side, and the rear side of the inkjet recording apparatus 1. As shown in FIG. 1, the inkjet recording apparatus 1 has a chassis 3 that is roughly rectangular in shape, with its long dimension running in the left-right direction. Two rails 4 that extend parallel to one another in the front-rear direction are provided approximately in the center of the inkjet recording apparatus 1. The two rails 4 are each supported on a base portion that rises in the vertical direction from the chassis 3 and is not shown in the drawings. A plate-shaped platen support platform (not shown in the drawings) that can be moved along the rails 4 in the front-rear direction of the chassis 3 is supported on the rails 4. A replaceable platen 5 is affixed to an upper end of a support post that rises vertically from the approximate center of the platen support platform.

The platen 5 is a plate that is roughly rectangular in shape, with its long dimension running in the front-rear direction of the chassis 3 in a plan view. A medium that is to be printed and is made of cloth, such as a T-shirt or the like, for example, is placed flatly on the top surface of the platen 5. In order to move the platen support platform, a platen drive motor 7 is provided on a rear end portion of a platen drive mechanism on which the rails 4 are provided. The driving of the platen drive motor 7 moves the platen support platform along the rails 4 in the front-rear direction of the chassis 3.

Guide rails 9 are provided between the left and right sides of the chassis 3, approximately in the center of the front-rear direction of the chassis 3 and in positions above the platen 5. The guide rails 9 guide the movement of a carriage 22 on which are mounted inkjet head units 2. The inkjet head units 2 are fastened by screws to the carriage 22 via a second base member 80. A driving of a carriage motor 24 moves the carriage 22 reciprocally in the left-right direction of the chassis 3 along the guide rails 9. The carriage motor 24 is provided close to the left ends of the guide rails 9.

Cyan ink, magenta ink, yellow ink, and black ink are used in the inkjet recording apparatus 1 in the present embodiment. Accordingly, an ink cartridge storage portion 8 is provided on the left side of the inkjet recording apparatus 1. Four ink cartridges that contain inks can be mounted in the ink cartridge storage portion 8. Ink supply tubes 6 that are flexible are coupled to the ink cartridge storage portion 8. The various colors of ink are respectively supplied to the inkjet head units 2 through the ink supply tubes 6.

Four of the inkjet head units 2 are mounted on the carriage 22. Each of the inkjet head units 2 is provided with discharge channels (not shown in the drawings) for discharging the corresponding ink. The discharge channels for each of the inkjet head units 2 may be 128 in number, for example. Each of the discharge channels is provided with an individually driven piezoelectric actuator (not shown in the drawings). An ink droplet is controlled such that the droplet is discharged downward from tiny nozzle holes 21 (refer to FIG. 3). The nozzle holes 21 are provided in a nozzle plate 20 on the bottom face of the inkjet head unit 2 such that the nozzle holes 21 respectively correspond to the discharge channels.

Figure 2:
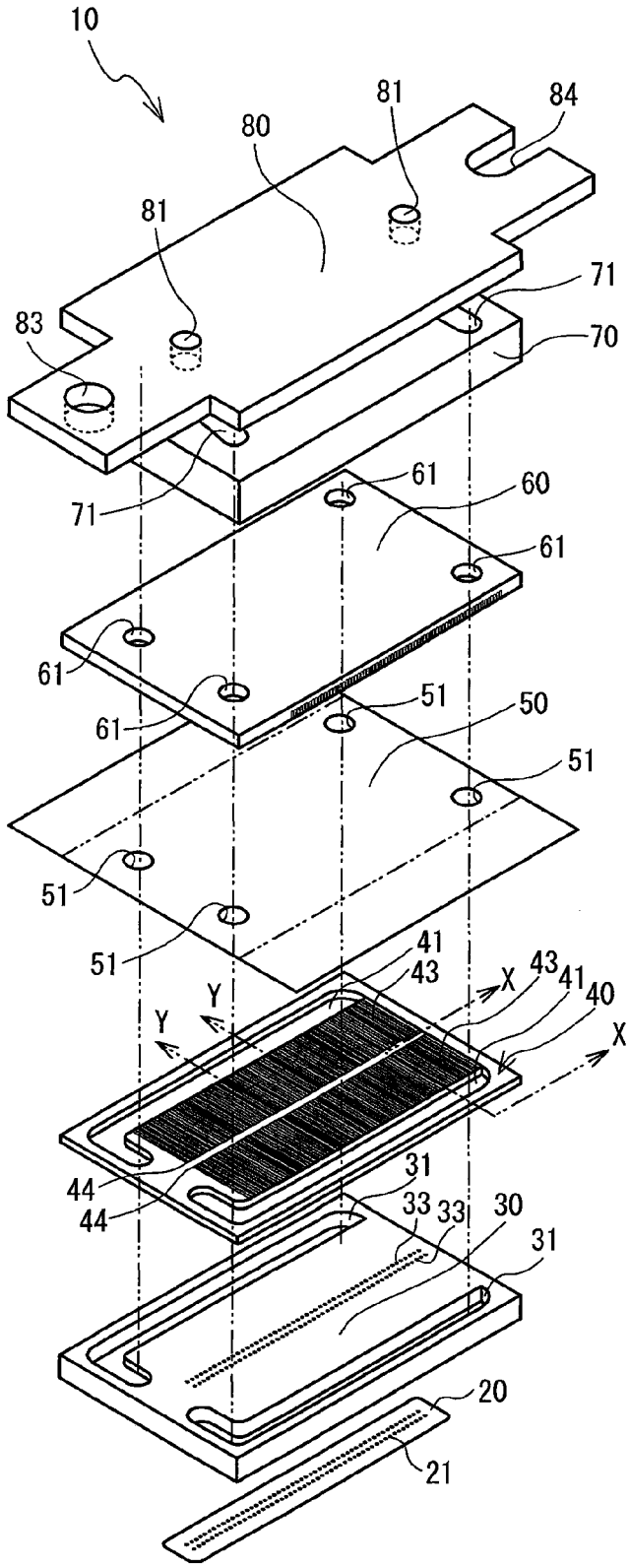
FIG. 2 is an exploded perspective view of an inkjet head 10.

As shown in FIG. 1, a sub-tank 25 is provided on each of the inkjet head units 2. The sub-tanks 25 are fastened to the carriage 22 via the second base member 80. The sub-tanks 25 temporarily accumulate the inks that are supplied through the ink supply tubes 6. An inkjet head 10 that is shown in FIG. 2 is provided in the bottom portion of each of the inkjet head units 2.

The structure of the inkjet head 10 in the first embodiment and a second embodiment will be explained with reference to FIGS. 2 to 6. The inkjet head 10 is configured such that the nozzle plate 20, a pressure chamber support member 30, a pressure chamber plate 40, a diaphragm 50, a piezoelectric element unit 60, a first base member 70, and the second base member 80 are stacked in that order from bottom to top.

The nozzle plate 20 will be explained. As shown in FIG. 2, the nozzle plate 20 is configured from a plate-shaped base plate that is made from ceramic. A plurality of the nozzle holes 21 are formed in the nozzle plate 20 in two uniform rows by microfabrication. The plurality of the nozzle holes 21 that are formed in the surface (the bottom surface) of the nozzle plate 20 function as nozzles for discharging the ink downward.

Figure 3:
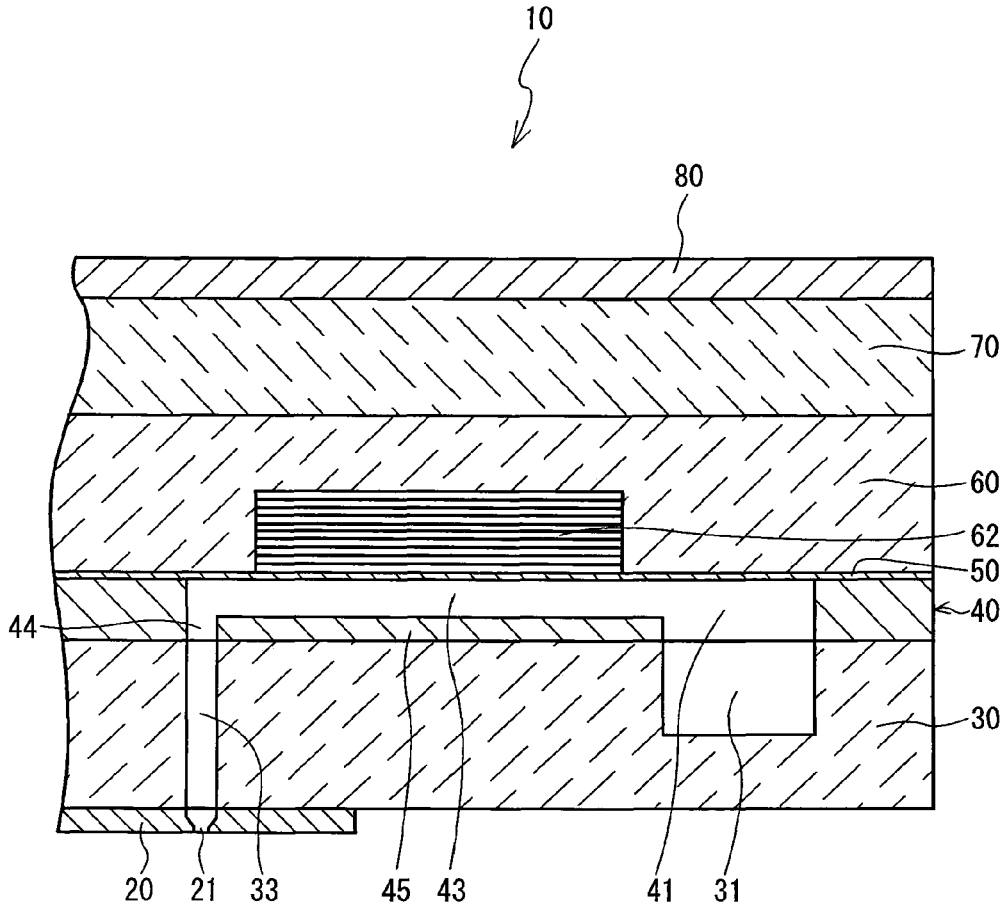
FIG. 3 is a section view of the inkjet head 10 at a section X-X that is shown in FIG. 2.
Figure 5:
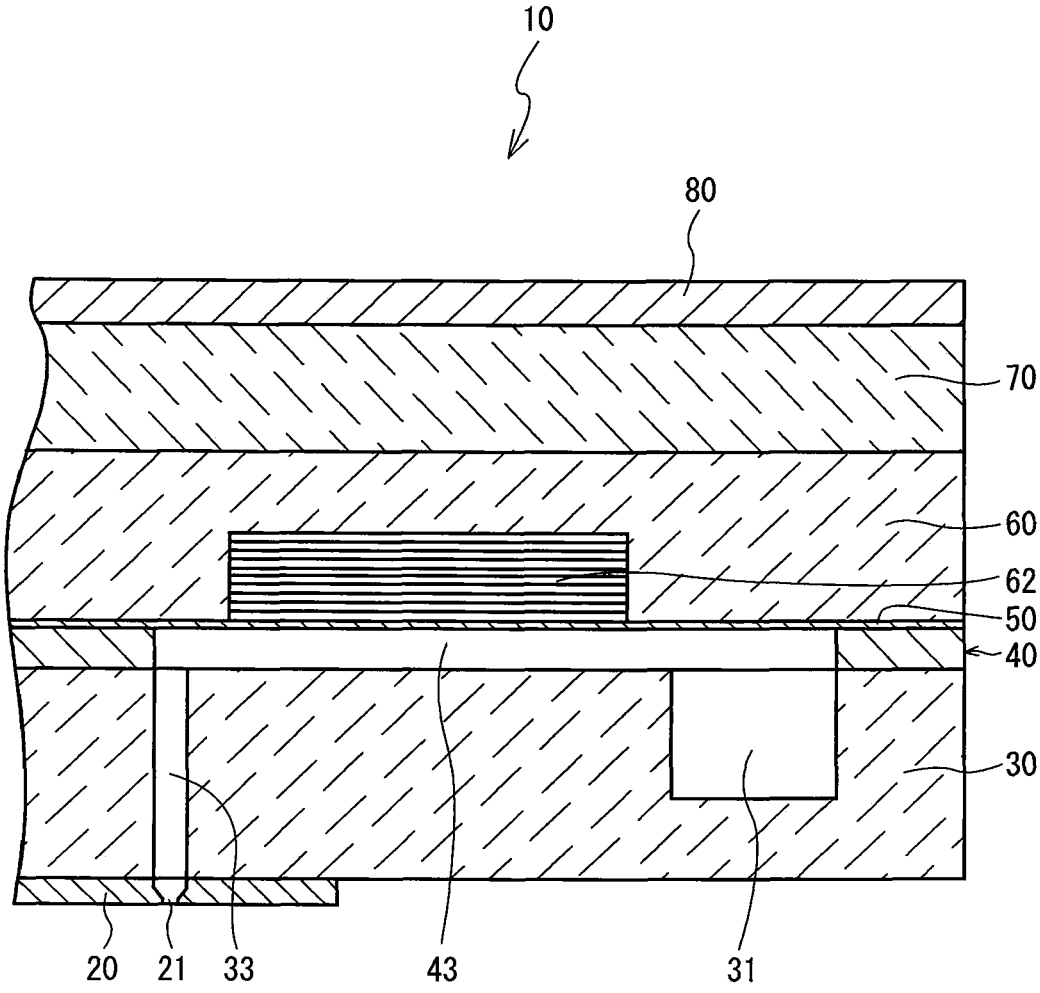
FIG. 5 is a section view of the inkjet head 10 in a second embodiment at the section X-X that is shown in FIG. 2.
Figure 6:
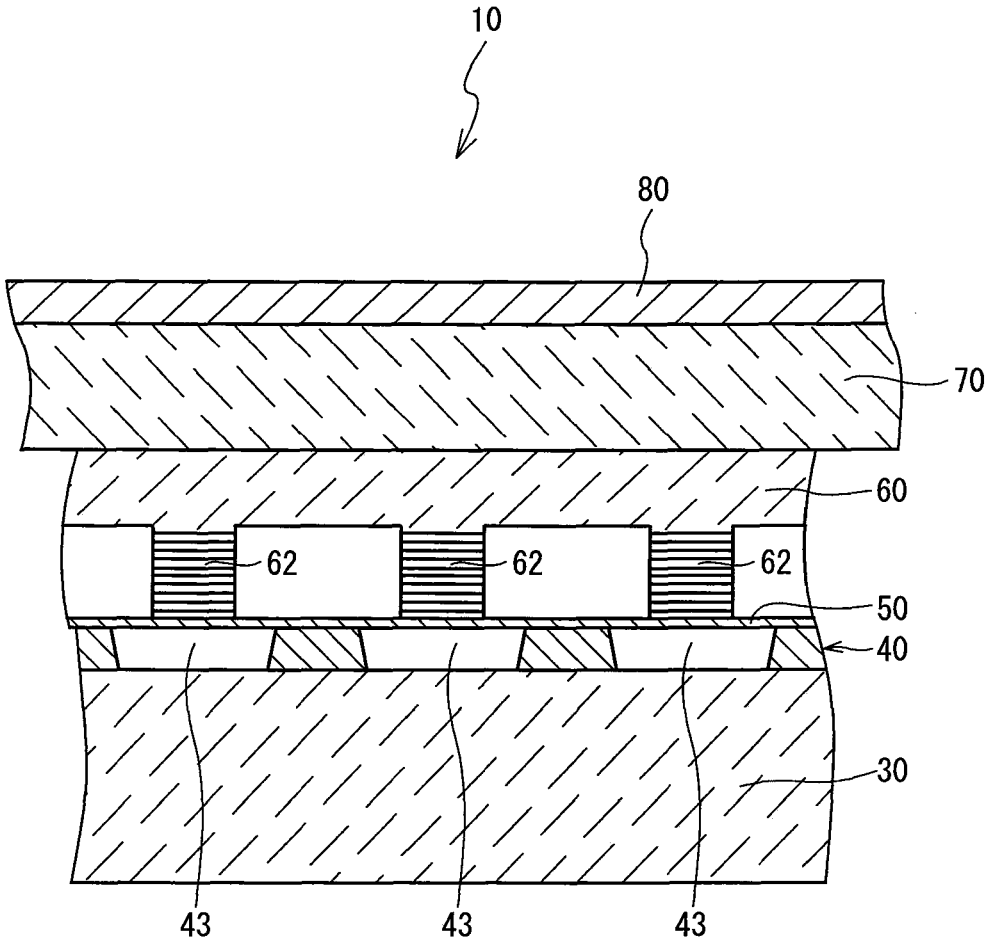
FIG. 6 is a section view of the inkjet head 10 in the second embodiment at the section Y-Y that is shown in FIG. 2.

The pressure chamber plate 40 will be explained. The pressure chamber plate 40 is configured from a thin plate made of metal that is rectangular in a plan view, as shown in FIG. 2. As shown in FIGS. 2 and 3, ink outlets 44 are formed in the pressure chamber plate 40 in two uniform rows, corresponding to the arrangement of the nozzle holes 21 in the nozzle plate 20. The ink passes through the ink outlets 44 and is supplied to the nozzle holes 21. Further, each of a plurality of pressure chambers 43 is connected to one of the ink outlets 44. The plurality of pressure chambers 43 extend in a direction that is orthogonal to the longitudinal direction of the pressure chamber plate 40. As shown in FIG. 3, the pressure chambers 43 are groove portions that are formed in the pressure chamber plate 40. Thus each of the pressure chambers 43 may be formed as a groove that has a bottom portion 45. In that case, each of the wall surfaces of the pressure chamber 43 is continuous with the bottom portion 45. It is therefore possible to maintain the shape of the pressure chamber 43 even when the pressure chamber plate 40 stands alone. This makes it possible to position the pressure chamber plate 40 easily on top of the pressure chamber support member 30 and to attach the pressure chamber plate 40 to the pressure chamber support member 30. Specifically, it is not necessary to be concerned with the load on the pressure chamber plate 40 when the pressure chamber plate 40 is being attached to the pressure chamber support member 30. It is therefore possible to improve the work efficiency of the attaching of the pressure chamber plate 40. The pressure chambers 43 may be slot portions without the bottom portions 45, such that the pressure chambers 43 are through openings in the thickness direction of the pressure chamber plate 40, as in the inkjet head 10 in the second embodiment, which is shown in FIGS. 5 and 6. In that case, the fabricating of the pressure chamber plate 40 may become easier. Furthermore, because the thickness of pressure chamber plate 40 becomes the depth of each of the pressure chambers 43, it is easily possible to consistently make the depth highly precise, with little dimensional variation.

Two ink supply channels 41 are provided in the pressure chamber plate 40 such that the ink supply channels 41 extend along the longitudinal direction of the pressure chamber plate 40. The ink supply channels 41 supply the ink to the pressure chambers 43. Stainless steel sheet or 42alloy, for example, may be used as the material for the pressure chamber plate 40. 42alloy includes 42% nickel by weight, with the remainder being iron. 42alloy also includes cobalt, silicon, titanium, molybdenum, manganese, carbon, and the like as unavoidable impurities. The coefficient of thermal expansion of 42alloy is low for a metal and is close to that of hard glass and ceramics. Therefore, in a case where the pressure chamber plate 40 that is made from 42alloy is joined to a ceramic or the like, it is possible to make the pressure chamber plate 40 such that the pressure chamber plate 40 will be resistant to warping and detachment due to a temperature change. Stainless steel has high corrosion resistance. This makes it possible to increase the choice of inks that can be used. In a case where the groove portions of the pressure chambers 43, the ink supply channels 41, and the ink outlets 44 are all formed in the pressure chamber plate 40 by an etching process, the groove portions, the ink supply channels 41, and the ink outlets 44 can be formed with high precision. In other words, it becomes easily possible to form the pattern of the pressure chambers 43 with high precision. Furthermore, the depths of the pressure chambers 43 can be controlled by controlling the time of the etching process. It is therefore possible to increase the degree of freedom in the design of the depth of the pressure chambers 43. In a case where the pressure chambers 43 are through openings in the thickness direction of the pressure chamber plate 40, the etching process may be performed until the pressure chamber plate 40 has been etched through. In a case where the bottom portions 45 of the pressure chambers 43 will be left, the etching process may be performed until the desired depth at which the bottom portions 45 will remain is reached. Thereafter, the pressure chambers 43 may be masked, and the ink supply channels 41 and the ink outlets 44 may be formed by performing the etching until through openings are formed in the thickness direction of the pressure chamber plate 40.

The configuration of the pressure chamber support member 30 will be explained. As shown in FIG. 2, the pressure chamber support member 30 is formed from a highly rigid ceramic plate that is rectangular in a plan view. The pressure chamber support member 30 supports the pressure chamber plate 40 and prevents deformation of the pressure chamber plate 40. In the pressure chamber support member 30, as shown in FIGS. 2 and 3, ink outlet holes 33 are formed in two uniform rows, corresponding to the arrangement of the nozzle holes 21 in the nozzle plate 20. The ink passes through the ink outlet holes 33 and is supplied to the nozzle holes 21. The ink outlet holes 33 are through holes in the thickness direction of the pressure chamber support member 30. On the face of the pressure chamber support member 30 that is on the opposite side from the face that faces the nozzle plate 20, the ink outlet holes 33 are formed in positions that correspond to the positions of the ink outlets 44 in the pressure chamber plate 40. As shown in FIGS. 2 and 3, ink supply channels 31 are formed in the pressure chamber support member 30. Together with the ink supply channels 41 in the pressure chamber plate 40, the ink supply channels 31 form common ink chambers that supply the ink to the pressure chambers 43.

The highly rigid ceramic material from which the pressure chamber support member 30 is formed will be explained with reference to Table 1. A ceramic material with a Young's modulus that is greater than that of the pressure chamber plate 40 is used for the pressure chamber support member 30. For example, in a case where one of stainless steel (Young's modulus: 200 Gpa) and 42alloy (Young's modulus: 150 Gpa) is used for the pressure chamber plate 40, a highly rigid ceramic material with a Young's modulus that is greater than those of stainless steel and 42alloy is used for the pressure chamber support member 30. For example, silicon carbide (Young's modulus: 430 Gpa), alumina (Young's modulus: 370 Gpa), silicon nitride (Young's modulus: 290 Gpa), or the like can be used for the pressure chamber support member 30. In these cases, the rigidity of the pressure chamber support member 30 increases, because the Young's modulus of the pressure chamber support member 30 is greater than that of the pressure chamber plate 40. Therefore, the deformation of the pressure chamber plate 40 can be prevented. The highly rigid metal materials such as tungsten (Young's modulus: 407 Gpa), molybdenum (Young's modulus: 330 Gpa), and cemented carbide (Young's modulus: 500 to 640 Gpa) can be used for the pressure chamber support member 30. Tungsten, molybdenum, and cemented carbide are high in cost and may be difficult to fabricate. However, even if the pressure chamber support member 30 is formed from the highly rigid metal material, the pressure chambers 43 are not formed in the pressure chamber support member 30, so microfabrication is not required. The parts cost can therefore be significantly reduced.

TABLE 1

| | Young's Modulus (Longitudinal Elastic Modulus) Gpa | Linear Coefficient of Expansion $10^{-6}$/° C. |
|---|---|---|
| Stainless Steel | 200 | 17 |
| 42Alloy | 150 | 4.5-6 |
| Silicon Carbide | 430 | 6.6 |
| Alumina | 370 | 7.2 |
| Silicon Nitride | 290 | 2.6 |
| Tungsten | 407 | 4.3 |
| Molybdenum | 330 | 5.1 |
| Cemented Carbide | 500-640 | 4.8-7.6 |

In a case where two layers of different types of materials are stuck together, the dimensional precision may decrease and warping may occur due to the difference in the coefficients of thermal expansion. A case is considered in which stainless steel (linear coefficient of expansion: $17\times10^{-6}$/° C.) is used for the pressure chamber plate 40. In this case, if one of silicon carbide (linear coefficient of expansion: $6.6\times10^{-6}$/°

C.) and alumina (linear coefficient of expansion: $7.2\times10^{-6}$/° C.) is used for the pressure chamber support member 30, the difference in the coefficients of thermal expansion is in the range of two to three times the lower coefficient. Therefore, the decrease in the dimensional precision and the warping can be prevented by sticking together the two layers of different types of materials at a low temperature and by factoring thermal expansion into the design. A case is considered in which 42alloy (linear coefficient of expansion: 4.5 to $6\times10^{-6}$/° C.) is used for the pressure chamber plate 40. In this case, 42alloy has a low coefficient of thermal expansion, so the difference in the coefficient of thermal expansion is small, compared with silicon carbide (linear coefficient of expansion: $6.6\times10^{-6}$/° C.), alumina (linear coefficient of expansion: $7.2\times10^{-6}$/° C.), and silicon nitride (linear coefficient of expansion: $2.6\times10^{-6}$/° C.). Therefore, in a case where one of silicon carbide, alumina, and silicon nitride is used for the pressure chamber support member 30, the decrease in the dimensional precision and the warping tend not to occur.

The diaphragm 50 will be explained. As shown in FIGS. 2 and 3, the diaphragm 50 is configured from a thin sheet material that is rectangular in a plan view. The diaphragm 50 plays the role of a cover on the pressure chambers 43 of the pressure chamber plate 40 and the role of a diaphragm. A thin metal sheet can be used as the diaphragm 50. A thin sheet of copper, stainless steel, or the like, for example, can be used as the thin metal sheet. Ink passage openings 51 are provided in the four corners of the diaphragm 50. The ink passes through the ink passage openings 51 to the ink supply channels 31 of the pressure chamber support member 30.

The piezoelectric element unit 60 will be explained. As shown in FIGS. 2 and 3, the piezoelectric element unit 60 is configured from a plate that is rectangular in a plan view. Piezoelectric element active portions 62 are provided in positions that correspond to the individual pressure chambers 43 of the pressure chamber plate 40. Each of the piezoelectric element active portions 62 serves as an actuator that, when a voltage is applied, causes the diaphragm 50 to be deformed such that the pressure of the ink in the corresponding pressure chamber 43 is increased or decreased. Ink passage openings 61 are provided in the four corners of the piezoelectric element unit 60. The ink passes through the ink passage openings 61 to the ink supply channels 31 of the pressure chamber support member 30.

The first base member 70 will be explained. As shown in FIGS. 2 and 3, the first base member 70 is configured from a plate that is rectangular in a plan view. The first base member 70 plays the role of a spacer that secures the piezoelectric element unit 60 to the second base member 80. The first base member 70 also plays the role of a flow channel that directs the ink from ink passage openings 81 in the second base member 80 to the ink passage openings 61 in the piezoelectric element unit 60. Ink flow channels 71 are provided close to the ends of the longitudinal direction of the first base member 70. The ink passes through the ink flow channels 71 to the ink passage openings 61 in the piezoelectric element unit 60.

The second base member 80 will be explained. As shown in FIGS. 2 and 3, the second base member 80 is a plate that is made of metal and that includes a portion that is rectangular in a plan view and portions that extend from each end of the rectangular portion in the longitudinal direction of the rectangular portion. Close to one end of the rectangular portion in the longitudinal direction of the second base member 80, a U-shaped notch 84 is provided, and close to the other end, a screw hole 83 is provided. Utilizing the notch 84 and the screw hole 83, the second base member 80 plays the role of a securing member that secures the inkjet head 10 to the carriage 22. A rigid stainless steel plate or the like, for example, may be used as the material for the second base member 80. The ink passage openings 81 are respectively provided close to the two ends in the longitudinal direction of the second base member 80. The ink passes through the ink passage openings 81 to the ink flow channels 71 in the first base member 70. Wiring and the like for the piezoelectric element unit 60, which are not shown in the drawings, are provided in the inkjet head 10.

Figure 4:
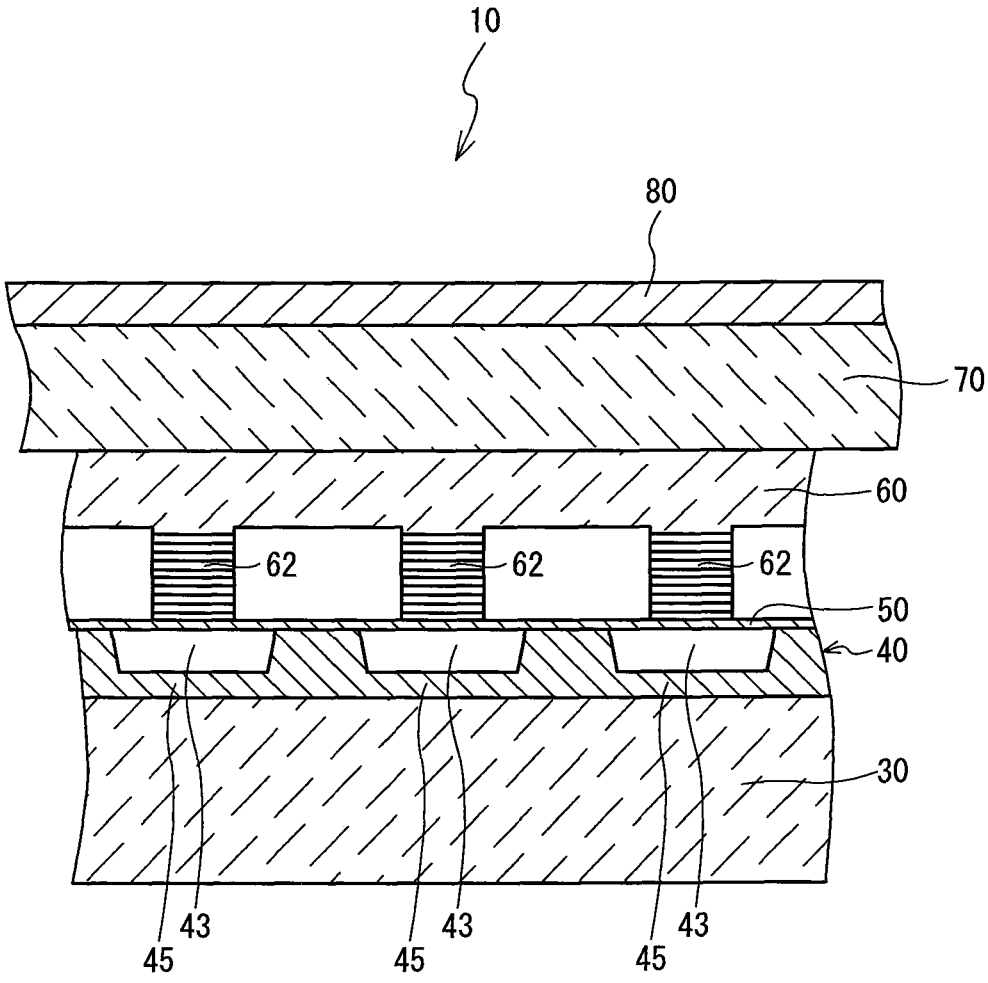
FIG. 4 is a section view of the inkjet head 10 at a section Y-Y that is shown in FIG. 2.

The method of producing the inkjet head 10 will be explained with reference to FIG. 7. First, a pressure chamber plate forming process is performed (Step S11). In the pressure chamber plate forming process, the pressure chamber plate 40 is formed by etching a metal sheet material. A sheet material that is made of one of stainless steel and 42alloy is used as the material for the pressure chamber plate 40. The thickness of the metal sheet material may be appropriate for the depth of the pressure chambers that will be formed. The etching process for the pressure chamber plate 40 may be half etching, as shown in FIGS. 3 and 4. In half etching, the amount of the material that is etched is less than the thickness of the pressure chamber plate 40, such that the bottom portions 45 of the pressure chambers 43 are left. In this case, each of the wall surfaces in the pressure chambers 43 is continuous with the corresponding bottom portion 45. It is therefore possible to maintain the shapes of the pressure chambers 43 even when the pressure chamber plate 40 stands alone. This makes it possible to position the pressure chamber plate 40 easily on top of the pressure chamber support member 30 and to attach the pressure chamber plate 40 to the pressure chamber support member 30. Specifically, it is not necessary to be concerned with the load on the pressure chamber plate 40 when the pressure chamber plate 40 is being attached to the pressure chamber support member 30. It is therefore possible to improve the work efficiency of the attaching of the pressure chamber plate 40. The etching process for the pressure chamber plate 40 may be full etching. In full etching, the amount of the material that is etched is the same as the thickness of the pressure chamber plate 40, such that the bottom portions 45 are not left. In this case, the pressure chambers 43 are through openings in the thickness direction of the pressure chamber plate 40. This makes the fabricating of the pressure chamber plate 40 easier. Furthermore, because the thickness of pressure chamber plate 40 becomes the depth of each of the pressure chambers 43, it is easily possible to consistently make the depth highly precise, with little dimensional variation.

Next, a fastening process is performed by bonding the pressure chamber plate 40 to the pressure chamber support member 30 (Step S12). The pressure chamber plate 40 has been formed in the pressure chamber plate forming process (Step S11). The pressure chamber support member 30 has been formed in advance from a highly rigid ceramic material by the CIM method. An epoxy type adhesive, for example, can be used as an adhesive.

In the production process for the inkjet head 10, a bonding process that bonds the first base member 70 to the second base member 80, which have been formed in advance, is performed in parallel with the processes at Steps S11 and S12 (Step 21). An epoxy type adhesive, for example, may be used as an adhesive. Next, the piezoelectric element unit 60 is bonded to the first base member 70 that has been bonded to the second base member 80 (Step S22). Thereafter, the diaphragm 50 is bonded to the piezoelectric element unit 60 (Step S23).

Next, an integration process is performed (Step S31). The assemblage that was formed in the processes at Steps S21, S22, and S23 is bonded to the pressure chamber plate 40 that was formed and bonded to the pressure chamber support member 30 in the processes at Steps S11 and S12, such that the separate parts are integrated into a single unit (Step S31). An epoxy type adhesive, for example, may be used as an adhesive. Next, the nozzle plate 20 is bonded to the bottom face of the pressure chamber support member 30 in the integrated unit (Step S32). An epoxy type adhesive, for example, may be used as an adhesive.

The inkjet head 10 according to the first embodiment that is shown in FIGS. 2 to 4 and the inkjet head 10 according to the second embodiment that is shown in FIGS. 5 and 6 can both be produced by the method of producing the inkjet head 10 that has been explained above.

In the inkjet heads 10 in the embodiments that have been described above, the pressure chambers 43 can be formed with high dimensional precision by using the etching of the metal sheet material to form the pressure chamber plate 40. The pressure chamber plate 40 can be formed with a high yield and at a low cost. Because the pressure chambers 43 are not formed in the pressure chamber support member 30, highly precise fabrication is not necessary for the pressure chamber support member 30, and the pressure chamber support member 30 can be formed from a ceramic material such as highly rigid alumina or the like. This means that the high parts cost that were due to the microfabrication can be significantly reduced. In a case where two layers of different types of materials are stuck together, the dimensional precision may decrease and warping may occur due to the difference in the coefficients of thermal expansion. However, the warping and the decrease in the dimensional precision can be prevented by sticking the two layers together at a low temperature and by factoring thermal expansion into the design. Highly precise and highly rigid ink chambers can therefore be produced at a low cost. This makes it possible to reduce the cost of an inkjet head that is compatible with a high-viscosity ink.

In the present disclosure, the inkjet head, the inkjet recording device, and the method of producing the inkjet head are not limited to the embodiments described above, and various types of modifications may be made.

For example, in the embodiments described above, the inkjet recording apparatus 1 that includes the inkjet head 10 is explained using an inkjet recording apparatus that performs printing on cloth as an example. However, the inkjet recording apparatus 1 is not limited to being an inkjet recording apparatus that performs printing on cloth, and the present disclosure can be applied to an inkjet recording device for various types of uses.

Figure 7:
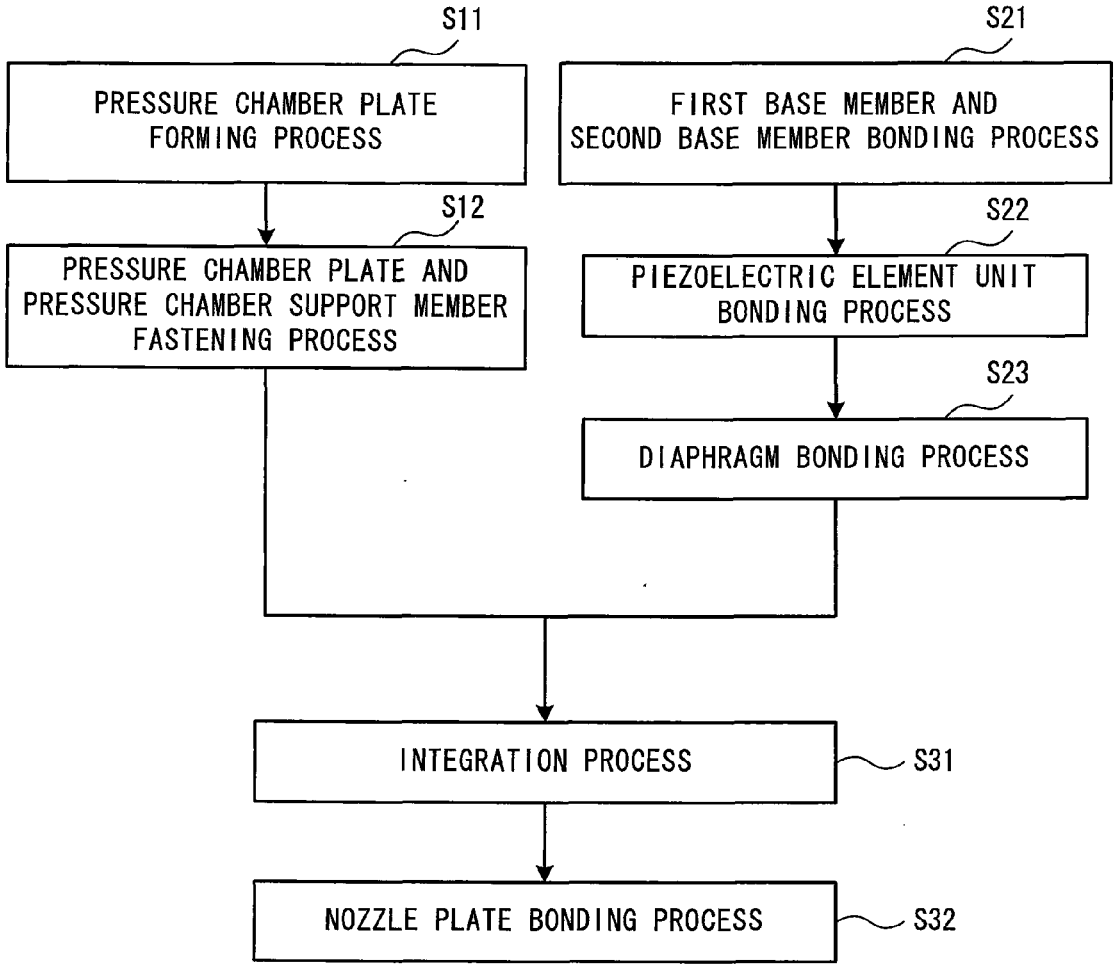
FIG. 7 is a flowchart that shows a production process for the inkjet head 10.
Figure 8:
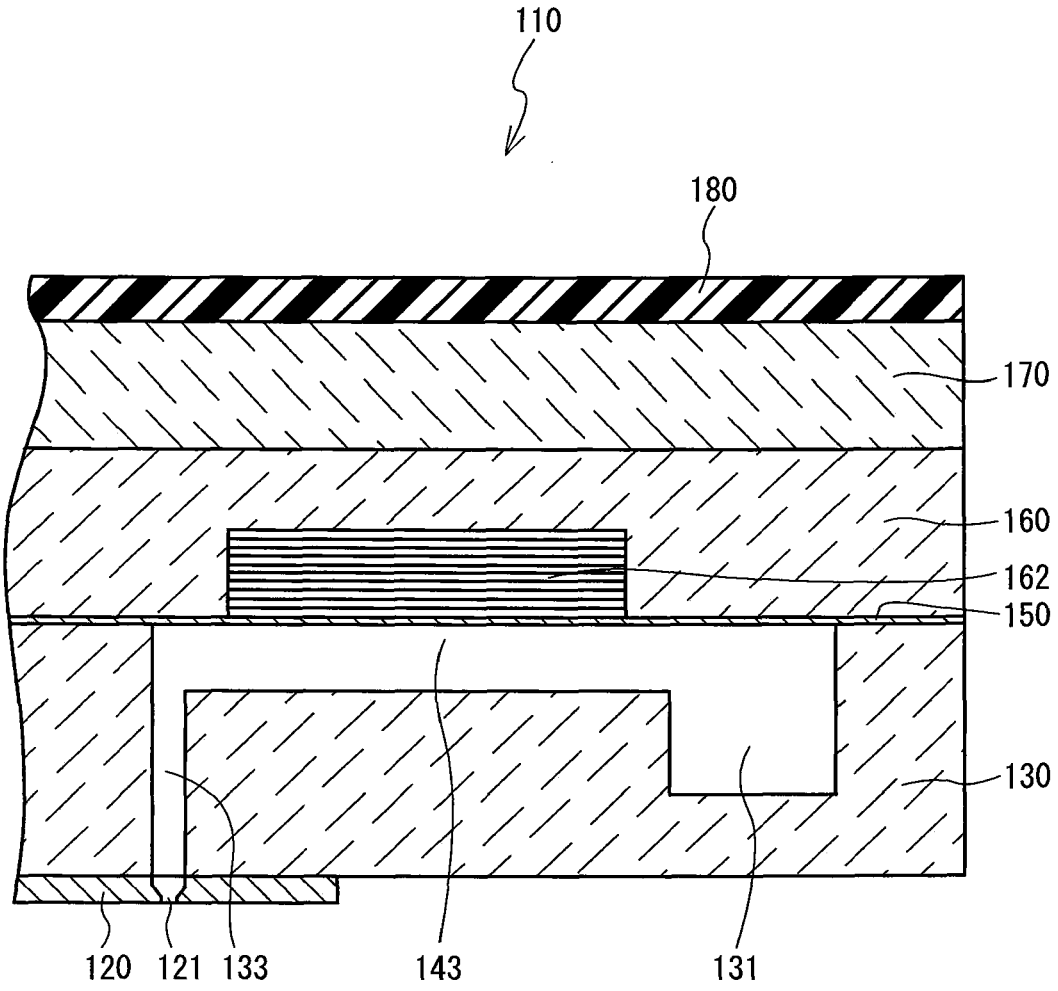
FIG. 8 RELATED ART
FIG. 8 is a section view of a known inkjet head 110.
Figure 9:
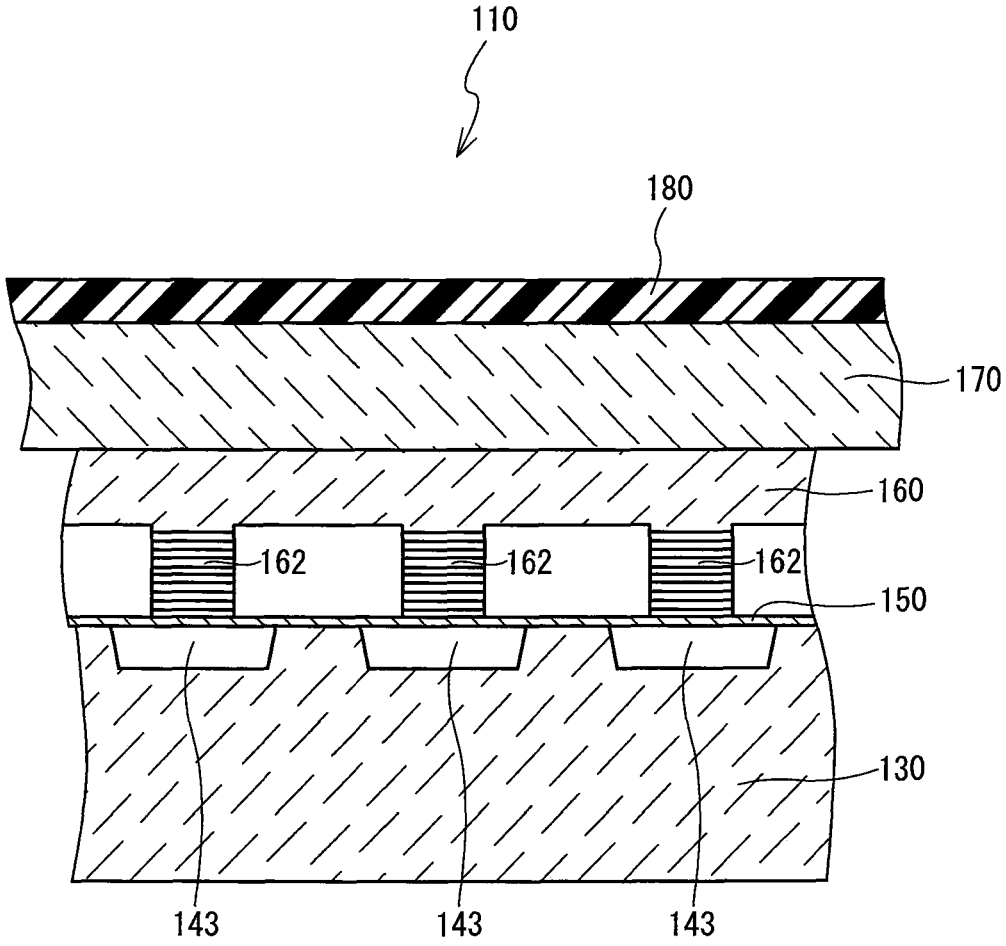
FIG. 9 RELATED ART
FIG. 9 is a section view of the known inkjet head 110.

The method of producing the inkjet head 10 that is shown in FIG. 7 is merely an example. The processes at Steps S21 to S23 may be performed in advance of the processes at Steps S11 and S12. The processes at Steps S21 to S23 may be performed in parallel with the processes at Steps S11 and S12. The pressure chamber support member 30 and the pressure chamber plate 40 are not limited to the examples described above. Any desired materials may be used for the pressure chamber support member 30 and the pressure chamber plate 40 as long as the Young's modulus for the pressure chamber support member 30 is greater than the Young's modulus for the pressure chamber plate 40 and the difference between the coefficients of thermal expansion is not large. The pressure chamber support member 30 may be made by firing any one of silicon carbide, alumina, and silicon nitride. The pressure chamber support member 30 may include at least one of silicon carbide, alumina, and silicon nitride as its main constituent, and may include another constituent.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. An inkjet head, comprising:

a plurality of nozzles through which ink is dischargeable out of the inkjet head;

a pressure chamber plate that is a single plate made of metal;

a plurality of pressure chambers that are groove portions formed in the pressure chamber plate for applying to the ink a pressure that is necessary in order to discharge the ink from the plurality of nozzles, a depth of each of the plurality of pressure chambers being less than a thickness of the pressure chamber plate;

an actuator that faces a first face of the pressure chamber plate and that includes a plurality of pressure generating portions, each of the plurality of pressure generating portions being adapted to impart a pressure to a corresponding one of the plurality of pressure chambers; and a pressure chamber support member that supports the pressure chamber plate from a second face of the pressure chamber plate, the second face being an opposite face to the first face, and that is made from a material that has a Young's modulus that is greater than a Young's modulus of a material from which the pressure chamber plate is made.

2. The inkjet head according to claim 1, wherein the pressure chamber plate is made from one of 42alloy and stainless steel.

3. The inkjet head according to claim 1, wherein the pressure chamber support member is made from a ceramic material that includes at least one of silicon carbide, alumina, and silicon nitride.

4. The inkjet head according to claim 1, wherein the pressure chamber support member is made from a metal material that includes at least one of tungsten, molybdenum, and cemented carbide.

5. The inkjet head according to claim 1, further comprising an ink supply channel that if formed in the pressure chamber plate and that is connected to each of the plurality of pressure chambers, wherein a length of the ink supply channel is one of equal to and greater than a length of a group of the plurality of pressure chambers in a direction in which the plurality of pressure chambers are arranged.

6. The inkjet head in accordance with claim 5, wherein the plurality of pressure chambers are arranged parallel to one another and a depth of the ink supply channel is equal to the thickness of the pressure chamber plate.

7. An inkjet recording apparatus comprising the inkjet head including:

a plurality of nozzles through which ink is dischargeable out of the inkjet head;

a pressure chamber plate that is a single plate made of metal;

a plurality of pressure chambers that are groove portions formed in the pressure chamber plate for applying to the ink a pressure that is necessary in order to discharge the ink from the plurality of nozzles, a depth of each of the plurality of pressure chambers being less than a thickness of the pressure chamber plate;

an actuator that faces a first face of the pressure chamber plate and that includes a plurality of pressure generating portions, each of the plurality of pressure generating portions being adapted to impart a pressure to a corresponding one of the plurality of pressure chambers; and a pressure chamber support member that supports the pressure chamber plate from a second face of the pressure chamber plate, the second face being an opposite face to the first face, and that is made from a material that has a Young's modulus that is greater than a Young's modulus of a material from which the pressure chamber plate is made.

8. The inkjet recording apparatus according to claim 7, wherein the pressure chamber plate is made from one of 42alloy and stainless steel.

9. The inkjet recording apparatus according to claim 7, wherein the pressure chamber support member is made from a ceramic material that includes at least one of silicon carbide, alumina, and silicon nitride.

10. The inkjet recording apparatus according to claim 7, wherein the pressure chamber support member is made from a metal material that includes at least one of tungsten, molybdenum, and cemented carbide.

11. The inkjet recording apparatus according to claim 7, wherein the inkjet head further includes an ink supply channel that is formed in the pressure chamber plate and that is connected to each of the plurality of pressure chambers, and a length of the ink supply channel is one of equal to and greater than a length of a group of the plurality of pressure chambers in a direction in which the plurality of pressure chambers are arranged.

12. The inkjet recording apparatus according to claim 11, wherein the plurality of pressure chambers are arranged parallel to one another and a depth of the ink supply channel is equal to the thickness of the pressure chamber plate.

13. A method of producing an inkjet head that includes a plurality of nozzles through which ink is dischargeable out of the inkjet head, a plurality of pressure chambers for applying to the ink a pressure that is necessary in order to discharge the ink from the plurality of nozzles, and an actuator that includes a plurality of pressure generating portions that are each adapted to impart a pressure to a corresponding one of the plurality of pressure chambers, the method comprising the steps of:

forming the plurality of pressure chambers as groove portions in a pressure chamber plate by etching the pressure chamber plate, the pressure chamber plate being a single plate made of metal, a depth of each of the plurality of pressure chambers being less than a thickness of the pressure chamber plate; and placing a pressure chamber support member on a face of the pressure chamber plate that is opposite to another face of the pressure chamber plate that faces the actuator, the pressure chamber support member being made from a material that has a Young's modulus that is greater than a Young's modulus of the pressure chamber plate.

14. The method according to claim 13, further comprising the step of forming an ink supply channel in the pressure chamber plate that is connected to each of the plurality of pressure chambers, wherein a length of the ink supply channel is one of equal to and greater than a length of a group of the plurality of pressure chambers in a direction in which the plurality of pressure chambers are arranged.

15. The method in accordance with claim 14, wherein the plurality of pressure chambers are arranged parallel to one another and a depth of the ink supply channel is equal to the thickness of the pressure chamber plate.

* * * * *